US007857302B2

(12) United States Patent
Wallace

(10) Patent No.: US 7,857,302 B2
(45) Date of Patent: Dec. 28, 2010

(54) VACUUM FRICTION FEEDER

(76) Inventor: Robert Brian Wallace, 31860 Mills Rd., Avon, OH (US) 44011

( * ) Notice: Subject to any disclaimer, the term of this patent is extended or adjusted under 35 U.S.C. 154(b) by 17 days.

(21) Appl. No.: 12/353,001

(22) Filed: Jan. 13, 2009

(65) Prior Publication Data

US 2009/0189334 A1 Jul. 30, 2009

Related U.S. Application Data

(60) Provisional application No. 61/023,653, filed on Jan. 25, 2008.

(51) Int. Cl.
*B65H 3/12* (2006.01)

(52) U.S. Cl. ..... 271/94; 271/99; 271/104; 271/165; 271/167; 271/171

(58) Field of Classification Search ..... 271/94, 271/99, 104, 145, 165, 166, 167, 171
See application file for complete search history.

(56) References Cited

U.S. PATENT DOCUMENTS 1,164,585 A 12/1915 Duvall
3,390,876 A 7/1968 Clem
5,167,407 A * 12/1992 Namba ..... 271/98
5,172,903 A * 12/1992 Haneda et al. ..... 271/171
5,269,508 A * 12/1993 Hattori ..... 271/171
5,295,676 A * 3/1994 Kenin et al. ..... 271/94
5,478,066 A 12/1995 Yoshida et al.
5,634,634 A * 6/1997 Dobbertin et al. ..... 271/3.02
5,722,652 A * 3/1998 Yoshida et al. ..... 271/11
5,967,507 A * 10/1999 Moore et al. ..... 271/94
6,543,760 B1 4/2003 Andren
6,607,193 B2 8/2003 Nordling et al.
7,059,597 B2 * 6/2006 Shirakura et al. ..... 271/171
2003/0047864 A1 * 3/2003 Nakamura et al. ..... 271/162

* cited by examiner

*Primary Examiner*—David H Bollinger
(74) *Attorney, Agent, or Firm*—Rankin, Hill & Clark LLP

(57) ABSTRACT

A vacuum friction feeder including at least one vacuum friction belt provided with a plurality of holes, a pair of rollers, a table top provided with at least one suction port, an exposure table having a substantially horizontal top surface and a separator. The at least one vacuum friction belt is adapted to rotate around the table top while supported by the rollers such that a suction pressure can be drawn through the plurality of holes provided in the at least one vacuum friction belt as the plurality of holes pass over the suction port. The exposure table is operatively associated with the table top and is adapted to be movable relative to the table top in a plane defined by the substantially horizontal top surface to adjust the portion of the bottommost product in the stack of products exposed to the at least one vacuum friction belt.

10 Claims, 8 Drawing Sheets

VACUUM FRICTION FEEDER

CROSS-REFERENCE TO RELATED APPLICATIONS

This application is a non-provisional of U.S. Provisional Application Ser. No. 61/023,653, filed Jan. 25, 2008.

BACKGROUND OF INVENTION

1. Field of Invention

The present invention generally relates to a material handling device and, more particularly, to a vacuum friction feeder.

2. Description of Related Art

Bottom-feeding friction feeders are used to individually remove flat stock from the bottom side of a stack and sequentially feed the flat stock into another device such as, for example, a printer, a labeler, a dryer, a collator, a folder or an inserter. Conventionally, the stack of flat stock is positioned such that a portion of the bottom sheet is exposed at an angle to one or more rotating rubber belts. By adjusting factors such as the angle of the stack relative to the belts (which is also known as the "wedge"), the speed of the belts etc., it is possible to sequentially draw a sheet of flat stock from the stack and separately feed the sheet into another device or a conveyor.

One of the problems that exists with conventional friction feeders is that it is often difficult, if not impossible, to feed different types of flat stock (e.g., flat stock which is thick, or rigid, or wide, or limp etc.) using the same friction feeder. Conventional devices have a difficult time feeding long, wide, dense flat stock (e.g., 36"×16" paper feed bags). In such applications, it is difficult to make appropriate adjustments to the "wedge" to expose an optimal amount of the material to the belts. Therefore, it is difficult to obtain enough control over the amount of exposure, particularly with longer products, to consistently feed product one at a time (i.e., without feeding multiple pieces at a time).

Another problem with feeding dense (heavy) material is the amount of material that may be loaded into the stack or "hopper". The angled design of conventional devices limits the amount of material that can be loaded into the hopper. Furthermore, testing has shown that in conventional friction feeders, as the amount of material remaining in the hopper changes (i.e., decreases over time), the belt exposure wedge conditions change. So as the material is feed and the hopper is depleted the feed characteristic is changed causing feed issues. All these problems make it difficult for the operator to setup and run current device in an effective manner.

Loading various size products is problematic because of the wedge design. Products longer than the feeder have to be supported behind the feeder in order to get any type of consistent feeding. With the conventional wedge design, the height at which the operator has to load the hopper becomes a major issue.

Feeding limp feed stock is also a problem for conventional friction feeders. In such applications, the product exposure wedge has to be set so close to the leading edge that the back of product becomes basically unsupported, which causes problems feeding when any significant amount of product is loaded in the hopper.

BRIEF SUMMARY OF THE INVENTION

The present invention is provides a vacuum friction feeder that overcomes the limitations of conventional vacuum friction feeders. In a preferred embodiment, the vacuum friction feeder is a bottom-feed vacuum friction feeder, which is suitable for use in mail handling, printing and in the packaging industry. A vacuum friction feeder according to the invention utilizes novel method of exposing the flat stock (also referred to herein as "product") to the belt(s). Product is loaded onto a substantially horizontal top surface of an exposure table.

More particularly, a vacuum friction feeder according to the invention includes at least one vacuum friction belt provided with a plurality of holes, a pair of rollers, a table top provided with at least one suction port, an exposure table having a substantially horizontal top surface and a separator. The at least one vacuum friction belt is adapted to rotate around the table top while supported by the rollers such that a suction pressure can be drawn through the plurality of holes provided in the at least one vacuum friction belt as the plurality of holes pass over the suction port. The substantially horizontal top surface of the exposure table is adapted to support a stack of products such that a portion of a bottommost product in the stack of products extends beyond an edge of the exposure table and is thereby exposed to the at least one vacuum friction belt above the suction port in the table top. The exposure table is operatively associated with the table top and is adapted to be movable relative to the table top in a plane defined by the substantially horizontal top surface to adjust the portion of the bottommost product in the stack of products exposed to the at least one vacuum friction belt. The separator is adapted to be adjustably positionable above the at least one vacuum friction belt such that no more than one product in the stack of products can pass therebetween at one time.

The vacuum friction feeder according to the invention can be adjusted to feed a wide variety of different product, including heavy, substantially rigid dense product to thin, limp product. In addition, the vacuum friction feeder according to the invention can feed product that is very long and/or very wide.

The foregoing and other features of the invention are hereinafter more fully described and particularly pointed out in the claims, the following description setting forth in detail certain illustrative embodiments of the invention, these being indicative, however, of but a few of the various ways in which the principles of the present invention may be employed.

DETAILED DESCRIPTION OF THE INVENTION

Figure 1:
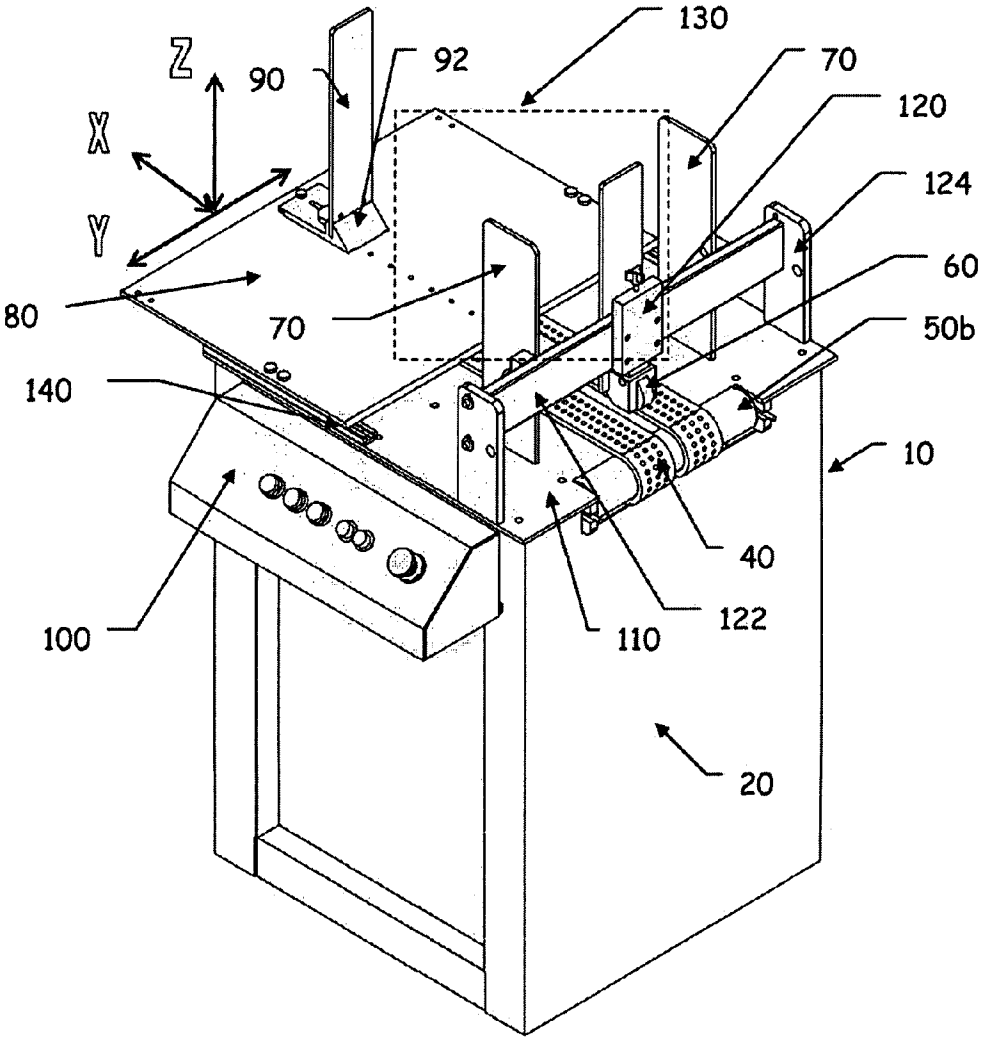
FIG. 1 is a perspective view of an exemplary floor model bottom-feed vacuum friction feeder according to the invention.
Figure 2:
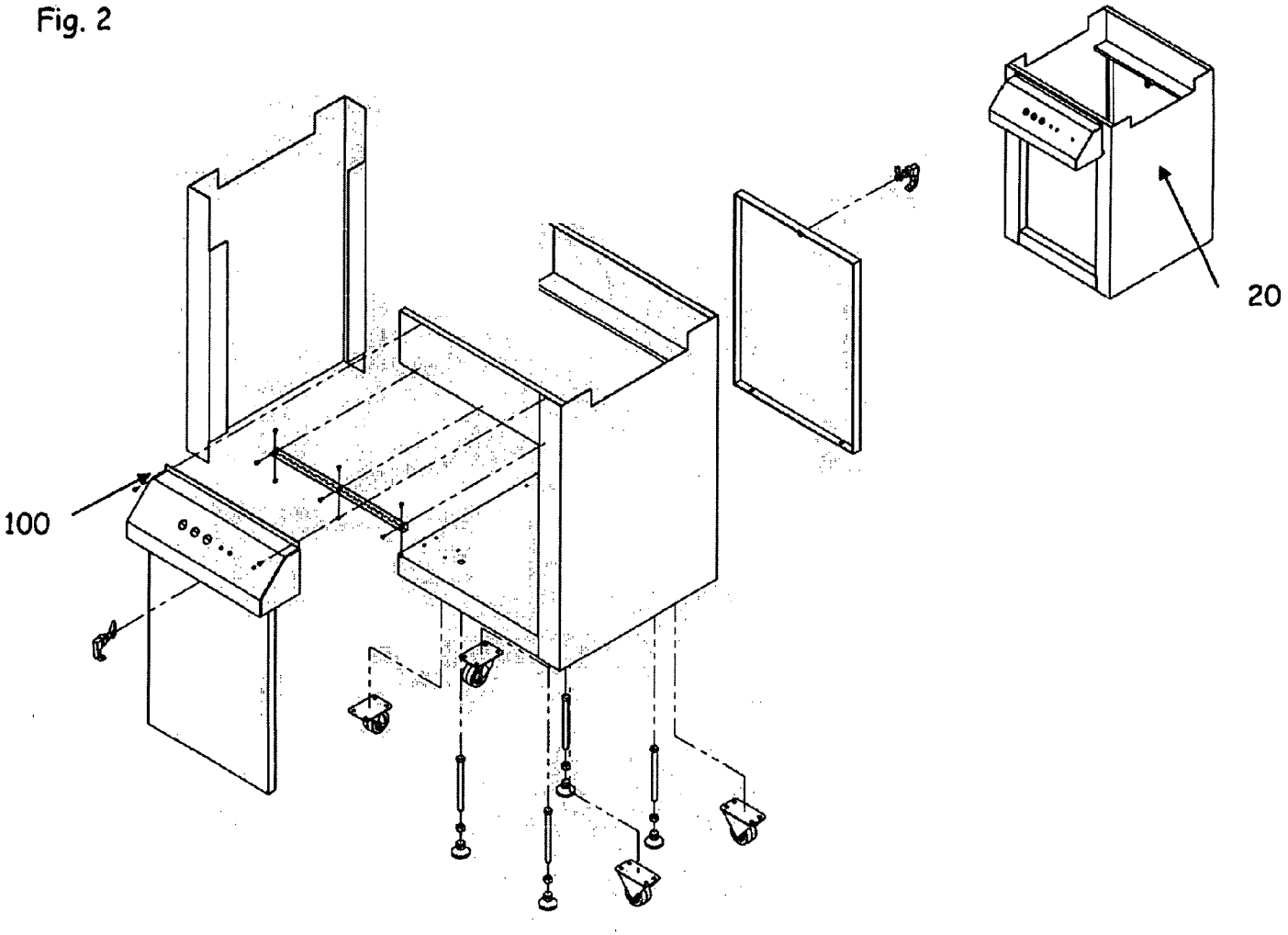
FIG. 2 is an exploded perspective view of the enclosure, electrical panel and operator controls of the vacuum friction feeder shown in FIG. 1.
Figure 4:
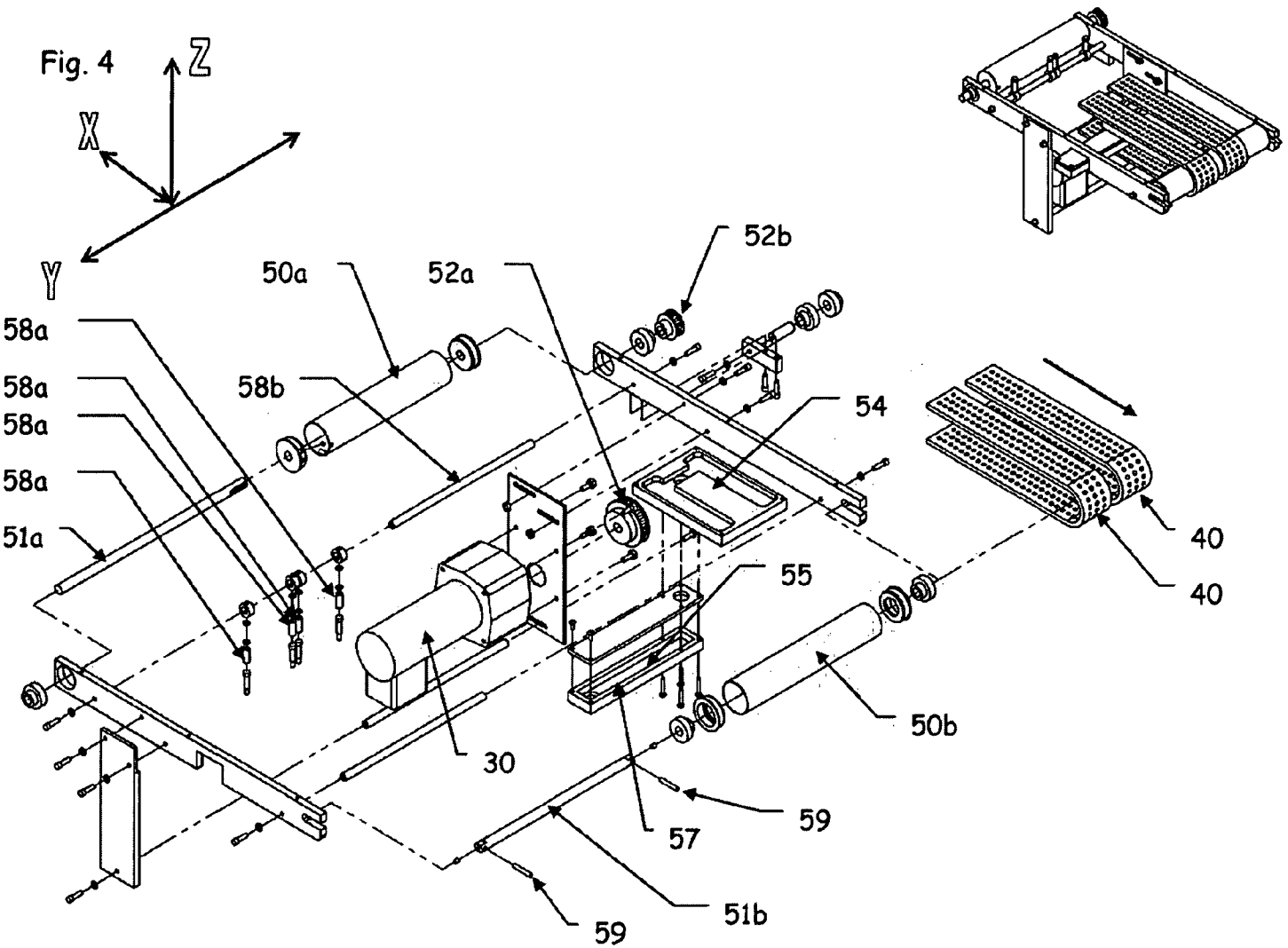
FIG. 4 is an exploded perspective view of the table subassembly of the vacuum friction feeder shown in FIG. 1, showing the frames, the rollers, the vacuum channel, drive motor and a portion of the belts.

FIG. 1 shows an exemplary floor model bottom-feed vacuum friction feeder 10 in accordance with the invention. The feeder 10 comprises an enclosure 20 (i.e., a cabinet), at least one and preferably two or more parallel vacuum friction belts 40, a pair of rollers 50*a*, 50*b* (see also FIG. 4) for supporting the vacuum friction belt(s) 40, a separator 60, a pair of opposing product side guides 70, an exposure table 80, at least one product back support 90, an operator control panel 100, a ported table top 110, a separator adjuster assembly 120, a hopper area 130 and an exposure table slide adjuster 140. FIG. 4 shows that the table subassembly has a drive motor 30, which drives (i.e., rotates) the vacuum friction belt(s).

Superimposed on FIG. 1 is an X-axis, which extends toward and away from the separator 60 in a plane defined by the top surface of the exposure table 80. Preferably the top surface of the exposure table 80 is horizontal and parallel to the floor space supporting the vacuum friction feeder 10. Also superimposed on FIG. 1 is a Y-axis, which extends perpendicular to the X-axis in the same plane as defined by the top surface of the exposure table 80. A Z-axis is also superimposed on FIG. 1. The Z-axis extends perpendicular to both the X-axis and the Y-axis (i.e., it is vertical).

Figure 3:
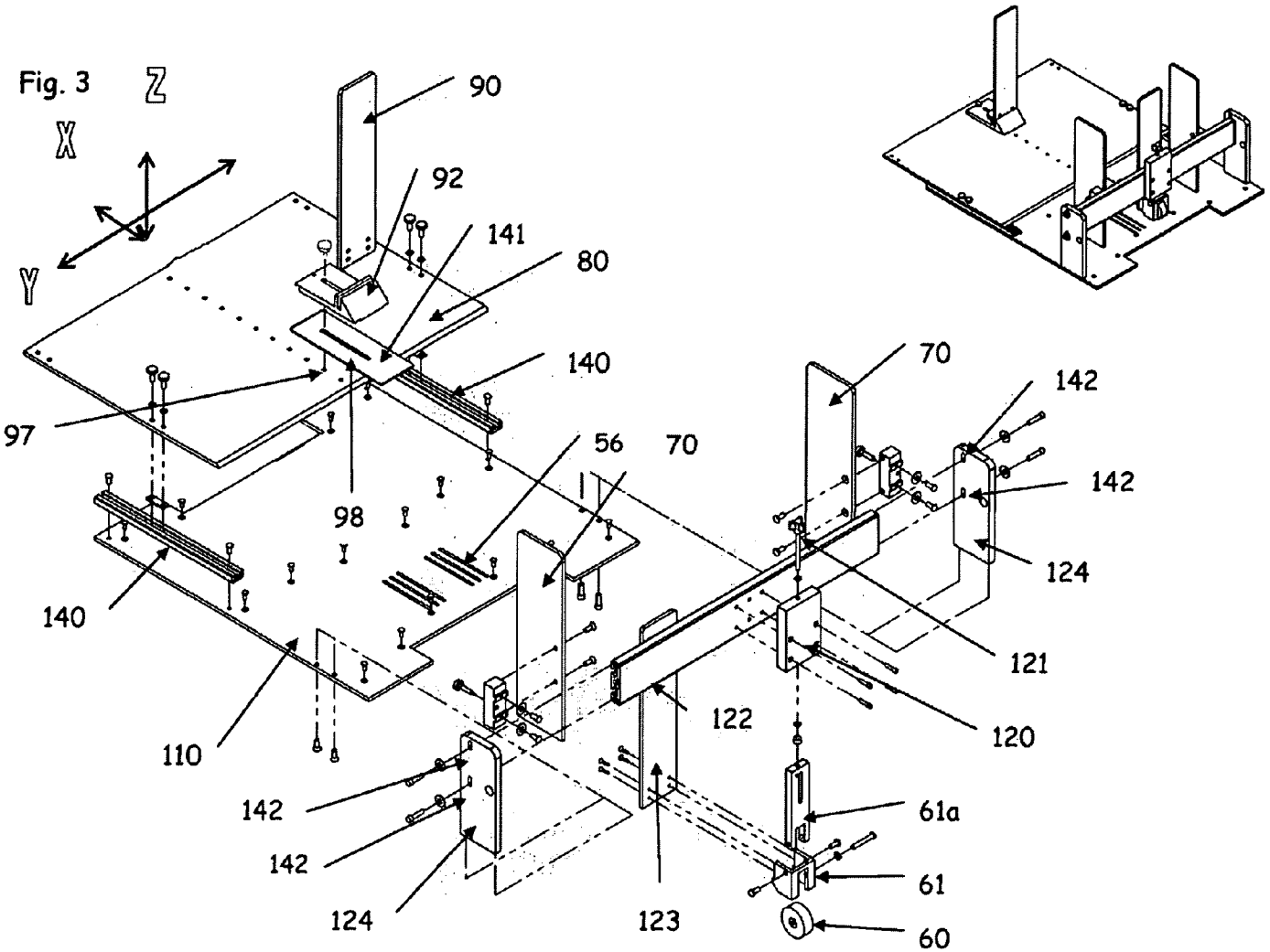
FIG. 3 is an exploded perspective view of the table assembly of the vacuum friction feeder shown in FIG. 1.

In the illustrated embodiment, the separator 60 extends from the separator adjuster assembly 120 and is adjustable in the Z-axis (i.e., upwardly and downwardly) by turning the separator adjusting screw 121, which is shown in FIG. 3. The separator assembly 120 is mounted to a bridge guide 122, which extends above the vacuum friction belts 40 in a plane parallel to the Y-axis. The bridge guide 122 is supported by a pair of feeder bridge posts 124, which are mounted to the ported table top 110. The bridge posts 124 are provided with slots 142 to allow the side guides 70 to move on the Z axis. This is done to allow the side guides 70 to be raised above belts 40 or close to the table top 110. The separator 60 is held in place by a separator adjusting fork 61*a* and a front support guide mount 61. The separator 60 can be rotated by loosening its mounting screw.

The opposing product support guides 70 are also supported by the bridge guide 122. The product support guides 70 can be moved along the bridge guide 122 to accommodate product of varying width. Generally, it is desirable to adjust the product support guides 70 such that they are spaced apart slightly wider than the width of the product, with the separator 60 centered on the product. FIG. 3 shows a front perspective and an exploded view of the bridge guide 122 and opposing product support guides 70.

FIG. 4 shows a portion of a pair of vacuum friction belts 40 and a pair of rollers 50*a*, 50*b*, which support the vacuum friction belts 40. A timing belt from the drive motor 30 timing pulley 52*a* drives a timing pulley 52*b* which is connected at one end to rear roller drive shaft 51*a*, which rotates the rear roller 50*a* and thus drives the vacuum friction belts 40 in the direction shown by the arrow depicted above the belts 40. The idle shaft 51*b* can be position along the X-axis to tension the friction belts 40 by adjusting belt tension screws 59. Adjustable bearing belt guides 58*a* are positioned along belt guide shaft 58*b* to keep the vacuum holes in the friction belts 40 in line with vacuum ports 56 in the ported table top 110. A vacuum box 54 is positioned in contact with the underside of the port table top 110 such that vacuum is transferred through the ported vacuum slots 56. The vacuum friction belts 40 proximal to the front roller 50*b* are aligned with their holes directly over the ported vacuum slots 56. The vacuum pulled through the vacuum box 54 creates a suction force through the ported top 110 (See FIG. 3) and transferred to the holes in the vacuum friction belts 40, which helps grab the bottom sheet or piece of product in the stack.

Figure 7:
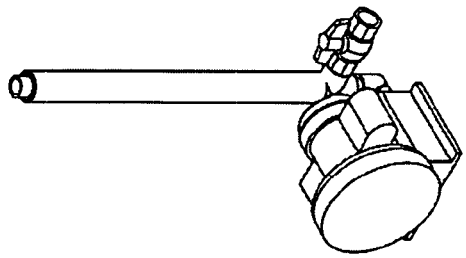
FIG. 7 shows both an exploded perspective view and an assembled perspective view of the vacuum plumbing assembly of the vacuum friction feeder shown in FIG. 1.
Figure 7:
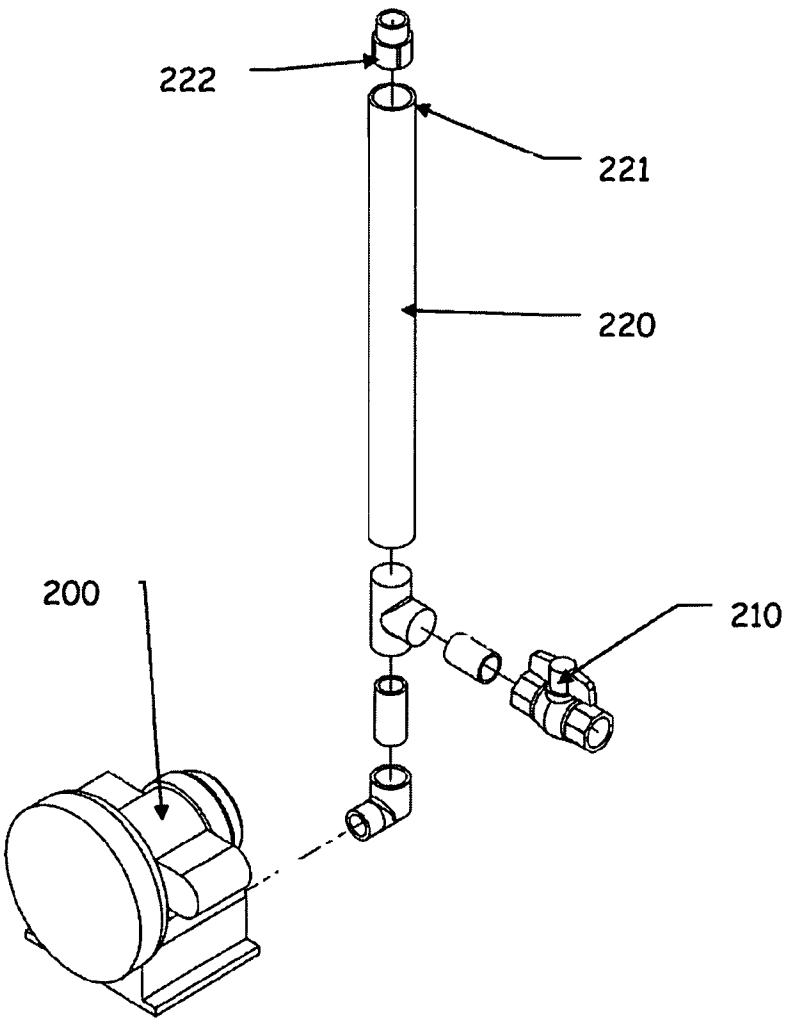
Figure 8:
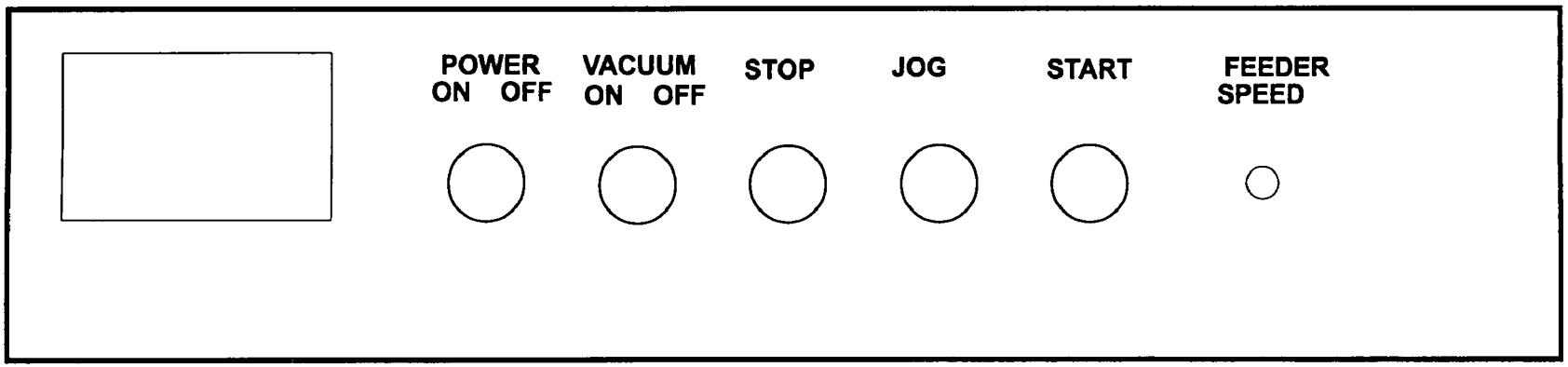
FIG. 8 is a side elevation view of an exemplary control layout on an operator control panel for a vacuum friction feeder according to the invention.

The vacuum, which could also be referred to as a negative pressure or suction, is provided by a vacuum blower 200 (see FIG. 7). It will be appreciated that some product may feed better without the use of a vacuum and based solely on the friction provided by the belts 40. The amount of vacuum produced can also be adjusted by opening or closing a vacuum bleed valve 210. The blower 200 draws a negative pressure or suction sequentially through the holes in the friction belts 40, through the slots 56 in the ported table 110, through vacuum box 54, through a vacuum offset box 55, through a tube 220 having an end 221 that communicates via a fitting 222 with an opening 57 in the vacuum offset box 55.

The product back support 90 is mounted to the top surface of the exposure table 80. Preferably, the exposure table 80 is provided with a plurality of mounting locations, which allow the product back support 90 to be adjusted in the X-axis (i.e., closer to or farther away from the separator) 60. The product back support 90 contacts the rear side of the stack of product, and includes as small wedge 92, which helps urge the product forward toward the separator 60.

The product back support 90 can be adjusted in the X-axis by turning a knob 91 having a threaded end 93 that is received in any of a series of threaded holes 97 in table 80 to reduce a clamping pressure between a bottom plate 141 and the top side of the table 80. The threaded end 93 of the knob 91 passes, sequentially, through a slot 96 in a rear portion of a block that includes the wedge 92, a slot 98 in the bottom plate 141 and into threaded hole 97 provided through the table 80. When the product back support 90 is positioned, where desired, the knob 91 can be turned in the opposite direction to produce a clamping pressure between the bottom plate 141 and the rear portion of the block that includes the wedge 92.

Figure 5:
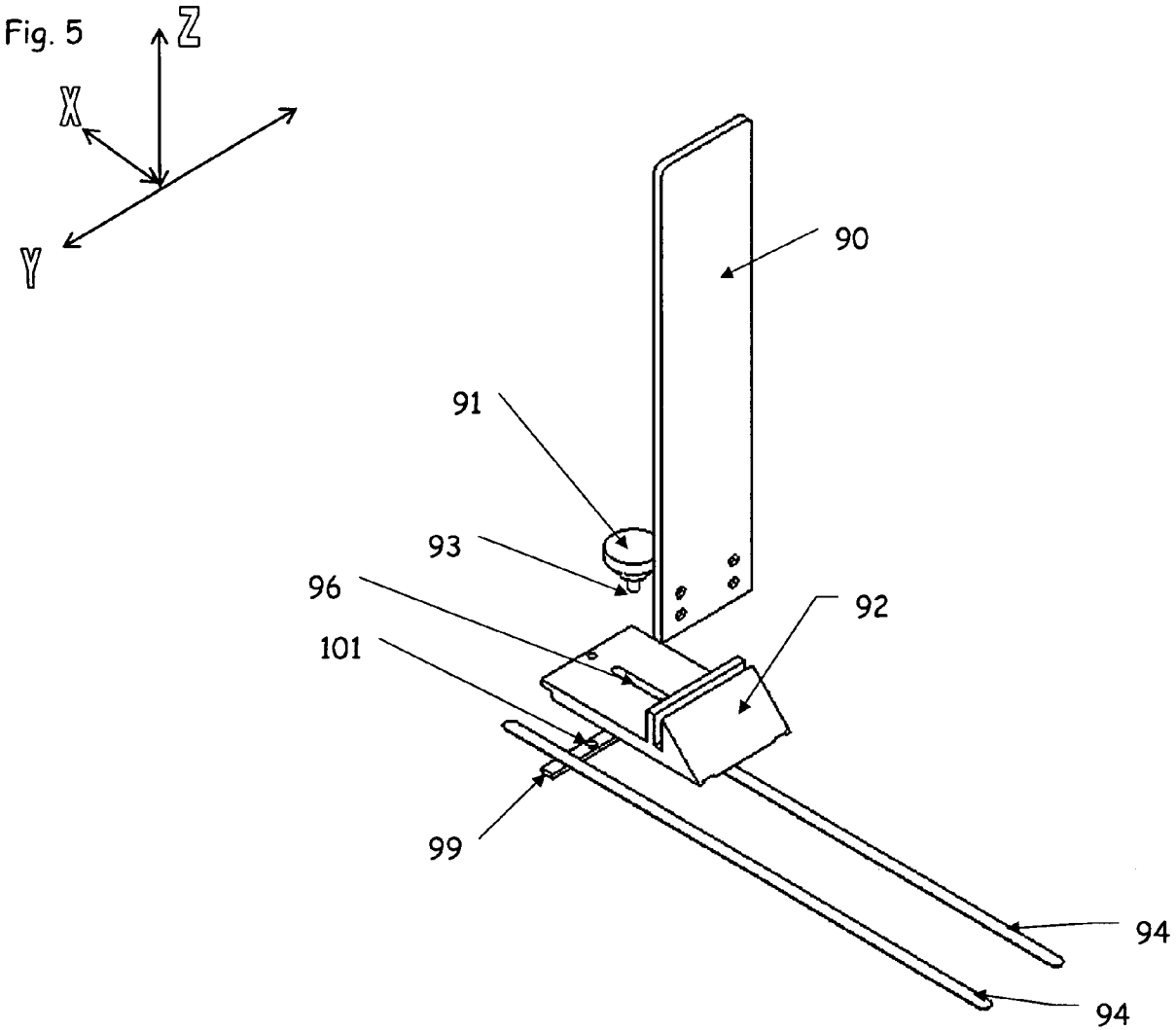
FIG. 5 is an exploded perspective view of an exemplary product back guide and product exposure extender fingers according to the invention.

FIG. 5 shows an exemplary embodiment of a product back support 90. In this embodiment, a pair of extenders 94 can be extended forward of the wedge 92. The extenders 94 allow for additional support in the X-axis when feeding small, limp product. The extenders 94 are biased between the bottom side of the wedge 92 and a rear side of the product back support 90, and can be fabricated from spring steel. The extenders 94 are connected by a cross-brace 99, which includes a hole 101 through which the threaded end 93 of the knob 91 passes. It will be appreciated that extenders 94 may not be needed in some applications and are therefore an optional component.

The exposure table 80, the opposing product support guides 70, the product back support 90 and the product front support 123 cooperate to define the hopper area 130. A stack of flat stock material, which is sometimes referred to herein as "product", is placed into the hopper area 130. The same feeder 10 can be quickly adjusted to efficiently feed large products, such as magazine publications, small sized product like post cards, and relatively thick and rigid, such as corrugated cardboard, to very thin, such as 20-lb paper.

Product is placed into the hopper area 130. The opposing product support guides 70 are adjusted as necessary to center the front of the product in relation to the separator 60. The product support guides 70 will be spaced apart slightly wider than the width of the stack of product. The product exposure table 80 is supported by the exposure table slide adjuster 140. The product exposure table 80 is adjusted such that an optimal portion of the product hangs over the edge of the exposure table 80 toward the vacuum friction belt(s) 40. The term "optimal portion" as used in this context means the amount of the product necessary to properly feed the product through the feeder one-piece-a-time. This "optimal amount" will differ based on the characteristics of the product. Thick, rigid product will require a greater portion to overhang the edge of the product exposure table 80 than thin, limp product. After the "optimal portion" has been determined for a particular product, this the operator can quickly and easily configure the feeder 10 for subsequent feeding operations. It will be appreciated that if the product is very short and/or limp, the bottom plate 141 can be extended to reach inside the product support guides 70 for additional exposure adjustment. Optional extenders 94 extending from product back support 90 may also be utilized very short and/or limp products.

Once the exposure table 80 and product support guides 70 have been adjusted, the height of the product separator 60 is adjusted. For thick and rigid product, the bottom edge of the separator 60 can ordinarily be set to 1.5 times the thickness of the product. For thin and limp product, it is usually best to place a piece of the product under the separator 60, and then lower the separator assembly 120 until the product exhibits a small amount of deflection below the vacuum friction belts 40. This separation deflection can be adjusted as a test feed is run, to make product flow smooth, with no multiple feeds. Once the separator 60 is properly adjusted, the product back support 90 can be adjusted such that it just slightly greater than the length of the product to load into the hopper area 130.

To initially set up the feeder 10 for a particular product, an operator loads a relatively small supply of product into the hopper area 130 and powers up the feeder 10 using the operator control panel 100. On power up, a vacuum is pulled through the vacuum box 54 positioned beneath the vacuum friction belt(s) 40. Once a sufficient vacuum has built up, the operator sets the feed speed to a low rate using the operator control panel 100 and depresses and holds a "JOG" button on the operator control panel 100. This causes the drive motor 30 to drive the vacuum friction belt(s) 40. The operator observes how the feeder 10 grabs the bottom-most piece of the product in the stack and separates that piece from the remainder of the stack. If necessary, the exposure table 80 can be adjusted along the X-axis to expose a greater or a lesser portion of the product to the vacuum friction belt(s) 40. In addition, the separator 60 can be raised or lowered along the Z-axis to achieve optimal operation. Once the exposure table 80 and the separator 60 are adjusted to feed the product, the operator adjusts the feed speed and presses a "START" button using the controls on the operator panel 100.

The operator control panel 100 contains switches, buttons and potentiometer controls to allow the operator to control the feeder 10. These controls preferably include: a power switch, a vacuum control switch, a stop button, a JOG button, a START button and a speed potentiometer. The power switch is used to turn the power on or off for the feeder 10. The vacuum control switch allows the operator to turn the vacuum blower 200 (see FIG. 7) on or off. The stop button disengages the drive motor 30 causing the friction belts 40 to stop. The JOG button engages the drive motor 30, which drives the friction belts 40 but only while the JOG button is depressed. The START button latches in the drive motor 30 to drive the friction belts 40 until the run latch is opened. The run latch can be opened in several manners which include but are not limited to, the stop button being depressed, the JOG button being depressed, power switch being turned to off or by and interlock to other equipment. The speed potentiometer is infinitely variable from a minimum speed, creeping, to the maximum speed of the drive motor 30.

A portion of the vacuum friction belt(s) 40 are exposed beyond the edge of the exposure table 80, with the remaining portion extending beneath the exposure table 80 the full length of the enclosure 20. It will be appreciated that the vacuum friction belt(s) 40 and enclosure can be made to any length necessary to feed extremely long and dense products. In addition, the width and number of vacuum friction belt(s) 40 can be varied, as necessary, in order to produce sufficient traction to drive and separate the products in an efficient and consistent manner. The bridge guide 122 and feeder bridge posts 124 can be made to any size to accommodate product of varying size. Counters and other electronics can be incorporated into the feeder to make the feeder a demand, batch or counter feeder. If more accurate starting and stopping is required, a servo drive could replace the drive motor 30.

The flat, horizontal exposure table 80 in the hopper area 130 allows for greater amounts a material to be loaded with out changing the dynamics of the bottom-most piece of product as it is being fed to the vacuum friction belt(s) 40. The use of a hopper area 130 having a flat, horizontal base also makes the feeder much easier to load with automatic loading devices as compared to conventional hoppers that have an angled base to produce a wedge.

Figure 6:
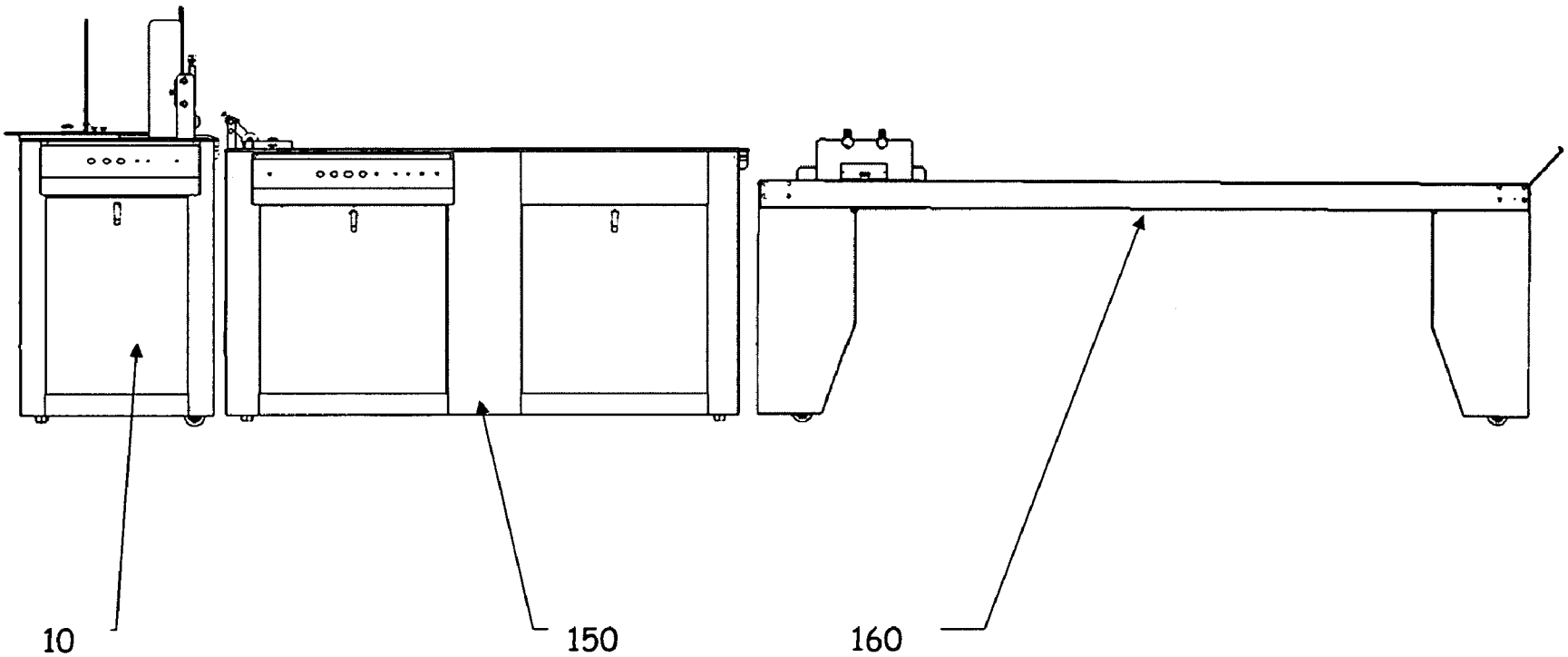
FIG. 6 is a side elevation view of an exemplary vacuum friction feeder according to the invention disposed in a material handling system.

The best mode for practicing the invention takes form in a commercial floor model bottom feed vacuum friction feeder for the printing, direct mail and small packaging markets. In this mode the feeder 10 will be placed in line with a transport base 150, typically used to inkjet or apply labels, and a conveying unit 160 as shown in FIG. 6.

The invention is intended to feed a variety of product, from 3"×5" postcard to envelopes, mailers and flat packaging materials. The size of the feeder can be varied to accommodate larger than normal products for customers or markets that require such.

Additional advantages and modifications will readily occur to those skilled in the art. Therefore, the invention in its broader aspects is not limited to the specific details and illustrative examples shown and described herein. Accordingly, various modifications may be made without departing from the spirit or scope of the general inventive concept.

What is claimed is:

1. A vacuum friction feeder comprising:

at least one vacuum friction belt provided with a plurality of holes;

a pair of rollers;

a table top provided with at least one suction port;

an exposure table having a substantially horizontal top surface; and a separator;

wherein the at least one vacuum friction belt is adapted to rotate around the table top while supported by the rollers such that a suction pressure can be drawn through the plurality of holes provided in the at least one vacuum friction belt as the plurality of holes pass over the suction port, wherein the substantially horizontal top surface of the exposure table is adapted to support a stack of products such that a portion of a bottommost product in the stack of products extends beyond an edge of the exposure table and is thereby exposed to the at least one vacuum friction belt above the suction port in the table top, wherein the exposure table is operatively associated with the table top and is adapted to be movable relative to the table top in a plane defined by the substantially horizontal top surface to adjust the portion of the bottommost product in the stack of products exposed to the at least one vacuum friction belt, and wherein the separator is adapted to be adjustably positionable above the at least one vacuum friction belt such that no more than one product in the stack of products can pass between the separator and the at least one vacuum friction belt at one time.

2. A vacuum friction feeder comprising:

at least one vacuum friction belt provided with a plurality of holes;

a pair of rollers;

a table top provided with at least one suction port;

an exposure table having a substantially horizontal top surface;

a separator; and at least one product back support assembly operatively associated with the exposure table;

wherein the at least one vacuum friction belt is adapted to rotate around the table top while supported by the rollers such that a suction pressure can be drawn through the plurality of holes provided in the at least one vacuum friction belt as the plurality of holes pass over the suction port, wherein the substantially horizontal top surface of the exposure table is adapted to support a stack of products such that a portion of a bottommost product in the stack of products extends beyond an edge of the exposure table and is thereby exposed to the at least one vacuum friction belt above the suction port in the table top, wherein the exposure table is operatively associated with the table top and is adapted to be movable relative to the table top in a plane defined by the substantially horizontal top surface to adjust the portion of the bottommost product in the stack of products exposed to the at least one vacuum friction belt, wherein the separator is adapted to be adjustably positionable above the at least one vacuum friction belt such that no more than one product in the stack of products can pass between the separator and the at least one vacuum friction belt at one time, and wherein the at least one product back support assembly includes a wedge for engaging a rear portion of the bottommost product in the stack of products to urge the bottommost product in the stack toward the separator.

3. The vacuum friction feeder according to claim 2 wherein the product back support assembly is slidably engageable with the exposure table.

4. The vacuum friction feeder according to claim 2 wherein the product back support assembly further comprises at least a pair of extenders that extend forward of the wedge.

5. A vacuum friction feeder comprising:

at least one vacuum friction belt provided with a plurality of holes;

a pair of rollers;

a table top provided with at least one suction port;

an exposure table having a substantially horizontal tog surface; and a separator;

wherein the at least one vacuum friction belt is adapted to rotate around the table top while supported by the rollers such that a suction pressure can be drawn through the plurality of holes provided in the at least one vacuum friction belt as the plurality of holes pass over the suction port, wherein the substantially horizontal top surface of the exposure table is adapted to support a stack of products such that a portion of a bottommost product in the stack of products extends beyond an edge of the exposure table and is thereby exposed to the at least one vacuum friction belt above the suction port in the table top, wherein the exposure table is operatively associated with the table top and is adapted to be movable relative to the table top in a plane defined by the substantially horizontal top surface to adjust the portion of the bottommost product in the stack of products exposed to the at least one vacuum friction belt, wherein the separator is adapted to be adjustably positionable above the at least one vacuum friction belt such that no more than one product in the stack of products can pass between the separator and the at least one vacuum friction belt at one time, and wherein the separator is operatively associated with a bridge support, the bridge support being mounted to a pair of opposing bridge posts mounted to the table top.

6. The vacuum friction feeder according to claim 5 wherein a pair of opposing side supports are each adjustably mounted to the bridge support, the pair of opposing side supports being adapted to be adjusted so as to be spaced apart slight wider than the width of the stack of products.

7. A vacuum friction feeder comprising:

two vacuum friction belts each of which is provided with a plurality of holes;

a pair of rollers;

a table top provided with at least two suction ports;

an exposure table having a substantially horizontal top surface;

a separator; and at least one product back support assembly operatively associated with the exposure table;

wherein the two vacuum frictions belts are adapted to rotate around the table top while supported by the rollers such that a suction pressure can be drawn through the plurality of holes provided in each of the two vacuum friction belts as the plurality of holes pass over the two suction ports, wherein the substantially horizontal top surface of the exposure table is adapted to support a stack of products such that a portion of a bottommost product in the stack of products extends beyond an edge of the exposure table and is thereby exposed to the two vacuum friction belts above the suction port in the table top, wherein the exposure table is operatively associated with the table top and is adapted to be movable relative to the table top in a plane defined by the substantially horizontal top surface to adjust the portion of the bottommost product in the stack of products exposed to the at least one vacuum friction belt, wherein the at least one product back support assembly includes a wedge for engaging a rear portion of the bottommost product in the stack of products to urge the bottommost product in the stack toward the separator, and wherein the separator is adapted to be adjustably positionable above the two vacuum friction belts such that no more than one product in the stack of products can pass between the separator and the two vacuum frictions belt at one time.

8. The vacuum friction feeder according to claim 7 wherein the separator is operatively associated with a bridge support, the bridge support being mounted to a pair of opposing bridge posts mounted to the table top.

9. The vacuum friction feeder according to claim 8 wherein a pair of opposing side supports are each adjustably mounted to the bridge support, the pair of opposing side supports being adapted to be adjusted so as to be spaced apart slight wider than the width of the stack of products.

10. A method for individually feeding a bottommost product from a stack of products, the method comprising:

providing a vacuum friction feeder comprising at least one vacuum friction belt provided with a plurality of holes, a pair of rollers, a table top provided with at least one suction port, an exposure table having a substantially horizontal top surface, and a separator, wherein the at least one vacuum friction belt is adapted to rotate around the table top while supported by the rollers such that a suction pressure can be drawn through the plurality of holes provided in the at least one vacuum friction belt as the plurality of holes pass over the suction port and wherein the exposure table is operatively associated with the table top and is adapted to be movable relative to the table top in a plane defined by the substantially horizontal top surface, positioning the stack of products on the substantially horizontal top surface of the exposure table such that a portion of a bottommost product in the stack of products extends beyond an edge of the exposure table and is thereby exposed to the at least one vacuum friction belt above the suction port in the table top;

moving the exposure table relative to the table top in the plane defined by the substantially horizontal top surface such that the portion of the bottommost product in the stack of products exposed to the at least one vacuum friction belt is adjusted;

positioning the separator above the at least one vacuum friction belt such that no more than one product in the stack of products can pass between the separator and the at least one vacuum friction belt at one time; and rotating the at least one vacuum friction belt such that the bottommost product in the stack of products is frictionally engaged by the at least one vacuum friction belt and thereby separated from the stack of product as it is fed between the separator and the at least one vacuum friction belt.

* * * * *

UNITED STATES PATENT AND TRADEMARK OFFICE

CERTIFICATE OF CORRECTION

PATENT NO. : 7,857,302 B2
APPLICATION NO. : 12/353001
DATED : December 28, 2010
INVENTOR(S) : Wallace It is certified that error appears in the above-identified patent and that said Letters Patent is hereby corrected as shown below:

In Column 7, Line 55, (Claim 5, Line 6), delete "tog" and insert --top--.

Signed and Sealed this
First Day of March, 2011

David J. Kappos

David J. Kappos
*Director of the United States Patent and Trademark Office*